US008939754B2

(12) United States Patent
Wang et al.

(10) Patent No.: US 8,939,754 B2
(45) Date of Patent: Jan. 27, 2015

(54) CURVED SURFACE FORMING DEVICE FOR ADJUSTABLE SEGMENTED MOLD BOARD WITH SQUARE RAMS

(75) Inventors: Chengfang Wang, Hubei (CN); Hetong Jiao, Shandong (CN); Yong Hu, Hubei (CN); Canyong Zhang, Shandong (CN); Jixian Li, Hubei (CN); Zhengyong Fan, Shandong (CN); Ping Yuan, Hubei (CN); Junwei Ma, Shandong (CN); Zuquan Xiang, Hubei (CN); Yunsheng Mao, Hubei (CN); Peiyong Li, Hubei (CN)

(73) Assignee: Shandong Surele Machinery Company Limited, Shangdong (CN)

( * ) Notice: Subject to any disclaimer, the term of this patent is extended or adjusted under 35 U.S.C. 154(b) by 437 days.

(21) Appl. No.: 13/138,466

(22) PCT Filed: Mar. 12, 2010

(86) PCT No.: PCT/CN2010/071008

§ 371 (c)(1),
(2), (4) Date: Aug. 22, 2011

(87) PCT Pub. No.: WO2010/102578

PCT Pub. Date: Sep. 16, 2010

(65) Prior Publication Data

US 2011/0300254 A1 Dec. 8, 2011

(30) Foreign Application Priority Data

Mar. 12, 2009 (CN) ..... 2009 1 0014794

(51) Int. Cl.

| | |
|---|---|
| ***B29C 43/04*** | (2006.01) |
| ***B21D 22/06*** | (2006.01) |
| ***B21D 37/02*** | (2006.01) |

(52) U.S. Cl.

CPC ..... *B21D 22/06* (2013.01); *B21D 37/02* (2013.01)

USPC ..... 425/403; 425/469; 425/394; 425/356; 425/450.1; 425/193; 249/155; 249/156

(58) Field of Classification Search

CPC B28B 7/02; B28B 7/025; G05B 2219/49025; B29C 33/301; B29C 33/302; B29C 33/308; B29C 43/02; B29C 43/021; B29C 2043/02; B29C 2043/021; B29C 33/42; B29C 43/361; B29C 33/307; B21D 22/06; B21D 37/02; B21D 37/04; B23Q 1/032; B23Q 1/035; B23Q 1/037; B23Q 1/25; B23Q 1/44; B23Q 1/64; B30B 11/02; B30B 11/027

USPC ..... 425/193, 469, 394, 403, 356, 450.1; 249/155, 156

See application file for complete search history.

(56) References Cited

U.S. PATENT DOCUMENTS

| | | | | |
|---|---|---|---|---|
| 1,295,542 | A * | 2/1919 | McIntyre | 72/413 |
| 1,312,268 | A * | 8/1919 | Poffinbarger | 72/478 |
| 4,212,188 | A * | 7/1980 | Pinson | 72/413 |
| 4,327,634 | A * | 5/1982 | Colmon et al. | 100/155 G |
| 5,546,784 | A * | 8/1996 | Haas et al. | 72/413 |
| 6,354,561 | B1 * | 3/2002 | Fahrion | 249/155 |

FOREIGN PATENT DOCUMENTS

| | | |
|---|---|---|
| CN | 2460239 | 11/2001 |
| CN | 2548792 | 5/2003 |
| CN | 2670024 | 1/2005 |
| CN | 2690070 | 4/2005 |
| CN | 101444810 | 6/2009 |
| CN | 101549377 | 10/2009 |
| DE | 42 13 490 | 9/1993 |
| JP | 5076937 | 3/1993 |

OTHER PUBLICATIONS

The technical solution of "Japanese multi-ram plate bending machine" for shipbuilding (Ship-Building Technology, China Communications Press, Dec. 1980, p. 141-149).

* cited by examiner

*Primary Examiner* — Timothy Kennedy
(74) *Attorney, Agent, or Firm* — Raymond Y. Chan; David and Raymond Patent Firm

(57) ABSTRACT

A curved surface forming device for an adjustable segmented mold board with square rams, consisting of an upper group and a lower group of adjustable molds (4) whose height can be adjusted, and a loading mechanism. The adjustable molds (4) are arranged in the loading mechanism and at least one group of adjustable molds (4) can move up and down under the drive of the loading mechanism. The upper group and the lower group of the adjustable molds (4) are respectively provided with M×N and (M−1)×(N−1) square rams (1) capable of swinging. The upper and the lower square rams (1) are arranged in an interlaced manner in both transverse and longitudinal directions. The square rams (1) are composed of a square plate (a) and the sphere (b) with the pressure imposition surface being a plane or a curved surface. The curved surface forming device can eliminate the crumpling and deformation generated in the board punching, reduce dents and improve processing quality.

4 Claims, 5 Drawing Sheets

CURVED SURFACE FORMING DEVICE FOR ADJUSTABLE SEGMENTED MOLD BOARD WITH SQUARE RAMS

This application is the U.S. national phase of International Application No. PCT/CN2010/071008 filed 12 Mar. 2010 which designated the U.S. and claims priority to CN Patent Application No. 200910014794.6 filed 12 Mar. 2009, the entire contents of each of which are hereby incorporated by reference.

BACKGROUND OF THE INVENTION

1. Technical Field

The present utility model relates to a device for board member curved surface forming which is mainly used for the forming of the adjustable segmented mold such as outer board plate members of hull with 3D curved surface and processing by plastic punching, and belongs to mechanical engineering field.

2. Description of Related Art

For the manufacturing of curved surface board parts, the traditional forming method mainly includes punching formation. However, punching formation is primarily used in large batch production. The processing of a part by this forming method generally requires several sets of integral type molds. The machined pieces formed by punching feature high precision and good quality, but there are still some problems such as high mold manufacturing cost and long production period.

With the rapid growth of the economy in China, the shipbuilding industry is developing quickly. The members similar to the hull plates in shipbuilding feature very low batch size, complicated shape, large scale and small curvature. It is almost impossible to machine an integral type mold for processing due to expensive costs. Therefore, for hull plate members with simple curvature in the prior art, three-core roller or oil hydraulic press is generally used for processing; while for hull plate members with complicated curvature, based on a primary formation, manual line heating is adopted for longitudinal bending. As is known to all, the plate forming process of line heating has the disadvantages of poor production conditions, high labor strength, high requirement for technical skills of the workers and low production efficiency.

Therefore, people began discussing the multi-ram and multi-point board formation.

The existing representative technical literature includes:

Literature 1: "Multi-point board formation device" for board punching (Patent Number: 02273508.9), etc.;

Literature 2: Patent DE4213490C1 and others used for airplane sheet skin technique;

Literature 3: the technical solution of "Japanese multi-ram plate bending machine" for shipbuilding (Ship-Building Technology, China Communications Press, December 1980, Page 141-149).

The ram in Literature 1 has a spherical surface. When punching formation, it contacts the plate at "multiple points". The dents on the plates after punching are obvious and the compressed and deformed parts of the plate may generate harmful crumpling and deformation. To avoid crumpling and deformation, additional edge-pressing cylinder, edge-pressing ring or pad or similar measures shall be provided around the mold. Unfortunately, this is still impossible to properly solve the problems of big dents and crumpling and deformation. The ram in Literature 2 has a spherical surface capable of swinging along with the plate shape, but the contacting with the plate is also points-based and the contact area is larger. To keep the smoothness of the plate, rubber pads or elastic pads shall be put under the plate to be processed, but the problems of big dents and crumpling and deformation still fail to be properly solved. The ram in Literature 3 has a disk-shaped surface capable of swinging along with the plate shape. Although the contact area of the ram and plate is much larger than that above, many parts of the plate exposed between every two disk rams fail to be pressed, which may lead to the compressed and deformed parts of the plate generating harmful crumpling and deformation. In addition, due to the instability of the compressed parts of the plate, the pair of up & down-aligned rams are driven to swing, this still makes the plate generate harmful crumpling and deformation. It can be concluded from the literature above that the ram has either a disk-shaped surface or a spherical surface. It is a technical difficulty for multi-ram board and multi-point board formation processing to prevent the generation of crumpling and deformation and reduce dents during punching of boards.

BRIEF SUMMARY OF THE INVENTION

The present invention aims at providing curved surface forming device for adjustable segmented mold board with square rams, and providing a new adjustable segmented mold of square rams with new curved surface appearance for changing the line heating for the curved surface member of large-size boards of ship to cold bending, eliminating the harmful crumpling and deformation of the board curved surface member generated during punching, reducing dents, improving processing quality and for the processing of hull plate curved surface members so as to realize formation processing of hull plate members by means of cold punching.

The purpose of the present invention mentioned above is realized as follows (detailed as below in combination with the drawings):

A curved surface forming device for an adjustable segmented mold board with square rams, which essentially consists of an upper group and a lower group of square rams 1 capable of swinging, height adjustable molds 4 and a loading mechanism, wherein the upper group and the lower group of adjustable molds 4 are arranged in the loading mechanism and at least one group of adjustable molds 4 can move up and down under the drive of the loading mechanism.

The adjustable molds 4 are provided with a group of square rams 1 in the quantity of M×N capable of swinging installed in the fixing frame 3, with the height of each square ram 1 adjustable, thus forming the upper or the lower adjustable molds 4; and a group of square rams 1 in the quantity of (M−1)×(N−1) capable of swinging installed on the supporting body 2 in the fixing frame 3, thus forming the upper or the lower adjustable molds 4; namely, when the mold of M×N square rams 1 is lower adjustable mold 4, the mold of (M−1)×(N−1) square rams 1 is upper adjustable mold 4; when the mold of M×N square rams 1 is upper adjustable mold 4, the mold of (M−1)×(N−1) square rams 1 is lower adjustable mold 4. The height of each square ram 1 in the upper and lower adjustable molds 4 is adjustable, and the square rams 1 of the upper and lower adjustable 4 are arranged in an interlaced manner in both transverse and longitudinal directions.

The use of the upper and lower groups of adjustable molds 4 can rapidly form a designed curved surface 5 densely arranged with very small clearance between square rams and maximum press-fit area. The loading mechanism 6 can be used to drive the upper adjustable mold 4 downwards to apply pressure on the board 7, thus realizing the purpose of board formation, or the loading mechanism 6 is used to drive the upper and lower adjustable molds 4 respectively to apply pressure on the board 7. The adjustable molds 4 can preferably replace expensive integral type molds.

The square rams 1 capable of swinging are composed of two parts: the square plate a and the sphere b. One side of the square plate a is pressure imposition surface and the other side is the sphere b; the pressure imposition surface is a plane or spherical surface; when the pressure imposition surface is a plane, the edge part can be provided with a taper or arc c. The sphere b is located on the supporting body 2 with concave spherical surface on the end in the fixing frame 3, and is flexibly coupled with the square rams 1 via the spring 8 so as to facilitate the swinging of the square rams 1.

The other end of the supporting body 2 is connected with the motor (stepper motor) through a screw stem 9. In this way, the square rams 1, supporting body 2, spring 8, screw step 9 and the motor form a square ram unit. To control the motor by numerical control method can adjust the height of the ram unit, namely the height of the square rams 1.

The upper and lower adjustable molds 4 are arranged in the following mode: the upper or lower adjustable molds 4 is composed of a group of (M−1)×(N−1) square rams 1 closely positioned in a rectangular shape, and the lower or upper adjustable mold 4 is compose of a group of M×N square rams 1 closely positioned in a rectangular shape, the projection of the center of the upper adjustable mold 4 and that of the lower adjustable mold 4 is coincident on a transverse plane, so the square rams 1 in the upper adjustable mold 4 and the lower adjustable mold 4 are symmetrically arranged in an interlaced manner in both transverse and longitudinal directions. When applying a pressure on the board 7, the square rams 1 of the upper and lower adjustable molds 4 can be mutually supported without the possibility of inclined swinging of the square rams 1 due to the deformation of the boards. Meanwhile, the superposition of the clearance between the square rams 1 of the upper adjustable mold and the clearance between the square rams 1 of the lower adjustable mold can be avoided, thus effectively preventing the crumpling, deformation and dents. Finally, the board 7 can be enforced to perform plastic formation in the clearance between the upper and lower adjustable molds 4.

Since the upper and lower adjustable molds 4 are provided with square rams 1 with plane pressure imposition surface, when the board is under punching, the square rams 1 contact the board on surface basis, thus greatly reducing the clearance between general rams. Moreover, the rams 1 of the upper and lower adjustable molds 4 are arranged in an interlaced manner so that the square rams 1 can be mutually supported. Therefore, the square rams 1 may not generate inclined swinging due to the deformation of the materials. Meanwhile, the superposition of the clearance between the square rams 1 of the upper and lower adjustable molds 4 can be avoided.

The use of the curved surface forming method of the boards for the adjustable segmented molds of square rams can rapidly form a curved surface densely arranged with very small clearance between square rams and maximum press-fit area. The smaller the size of the square rams 1, the narrower the clearance between the square rams 1, smoother curve shape and better quality can make the substitution with the expensive integral type mold in a better way. Compared with other multiple rams or rams with multi-point board formation, the square rams forming the adjustable segmented molds have a large area contacting the work piece to be processed, almost covering the whole board to be processed. Meanwhile, the square rams in the upper and lower adjustable segmented molds are arranged in an interlaced manner in both transverse and longitudinal directions, can be mutually supported under pressure and may not generate inclined swinging due to the deformation of boards, so the boards are enforced to conduct plastic formation in the clearance defined by the upper and lower adjustable segmented molds, thus capable of effectively preventing the generation of crumpling defects, reducing the dent defects and dramatically improving the board formation quality.

In the present invention, the adjustable molds 4 are designed. On the section of the adjustable molds 4, the transverse direction of the section of the square rams 1 is set to be parallel to the transverse direction of the section of the fixing frame 3; the longitudinal direction of the section of the square rams 1 is set to be parallel to the longitudinal direction of the section of the fixing frame 3.

In the present invention, the adjustable molds 4 are designed. On the section of the adjustable molds 4, the angle included between the transverse direction of the section of the square rams 1 and the transverse direction of the section of the fixing frame 3 is set to be 45±6°; the angle included between the longitudinal direction of the section of the square rams 1 and the longitudinal direction of the section of the fixing frame 3 is set to be 45±6°.

Figure 1:
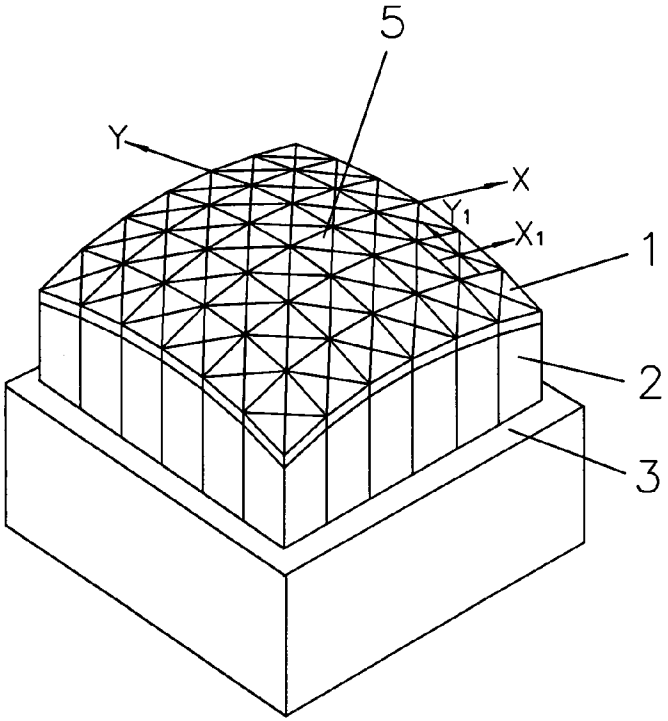
FIG. 1 is the schematic view of the curved surface forming method by using the adjustable segmented molds of square rams.

Where: 1—square ram; 2—supporting body; 3—fixing frame; 4—adjustable mold; 5—designed curved surface; 6—pressing machine; 7—board; 8—spring; 9—screw stem; 10—drive motor.

DETAILED DESCRIPTION OF THE INVENTION

The specific contents and working process of the present invention are further detailed in combination with the embodiments shown in the drawings.

The curved surface forming device for adjustable segmented mold board with square rams are mainly used for the formation processing of large-scale 3D board such as the hull plate members in ship building. Different from other board formation processing, the square rams in the present invention are primarily used to construct the adjustable segmented molds densely arranged with very small clearance between rams and of near integral type to make any curved shape, thus addressing the technical difficulties of crumpling and deformation generated during board punching.

FIG. 1 is the schematic view of the curved surface forming method by using the adjustable segmented molds of square rams. The adjustable molds 4 with M×N square rams 1 capable of swinging are installed in the fixing frame 3. The rams can be driven to move upwards or downwards by electric means or other methods, and can be adjusted on height by the numerical control method, forming the lower adjustable mold 4. The pressure imposition surface of the square rams 1 on the adjustable mold 4 is flat. The lower adjustable mold 4 can rapidly form a designed curved surface 5 densely arranged with very small clearance between square rams and maximum press-fit area. The adjustable molds 4 can preferably replace expensive integral type molds. The square size of the square rams 1 are slightly smaller than the square section size of the adjustable molds 4. It is only required to meet the swinging requirement fit for the bending plate. The smaller the size of the square rams 1, the smoother the curved surface appearance and the better the quality. The size of the square rams 1 shall be determined in accordance with the specifications of the normally used boards in real life processing.

The section of the fixing frame 3 is provided with axis X and Y directions. The section of the square rams 1 is provided with axis X1 and Y1 directions. In this embodiment, the sectional area for all the square rams 1 is set to be the same, the axis X1 of the square rams 1 is set to be parallel to the axis X direction of the fixing frame 3, and the axis Y1 of the square rams 1 is set to be parallel to the axis Y direction of the fixing frame 3, so that the rams 1 in the adjustable molds 4 are arranged in a parallel and paracytic manner in both transverse direction and longitudinal direction on the section of the adjustable molds 4. In another embodiment of the present invention, the sectional area of all square rams 1 is set to be the same, the angle included between the axis X1 of the square rams 1 and the axis X of the fixing frame 3 is set to be 45°, and the angle included between the axis Y1 of the square rams 1 and the axis Y of the fixing frame 3 is set to be 45°, so that the rams in the adjustable molds 5 are arranged in a diamond manner in both transverse direction and longitudinal direction on the section of the adjustable molds 4.

Figure 2:
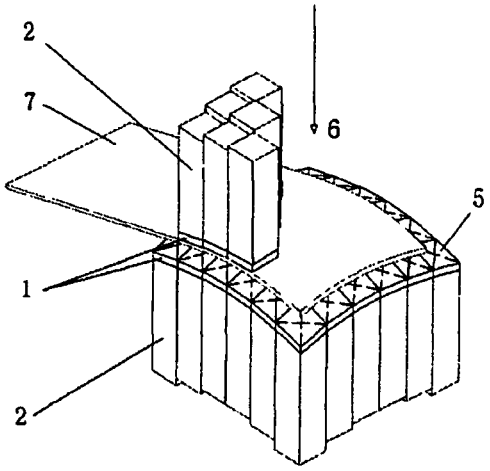
FIG. 2 is the schematic view of the ship plate curved surface forming method by using the adjustable segmented molds of square rams.

FIG. 2 is the schematic view of the ship plate curved surface forming method by using the adjustable segmented molds of square rams. The adjustable molds 4 with M×N square rams 1 capable of swinging are installed on the supporting body 2 in the fixing frame 3. The rams can be driven to move upwards or downwards by electric means or other methods, and can be adjusted on height by numerical control method, forming the lower adjustable mold 4. Similarly, a group of (M−1)×(N−1) square rams 1 capable of swinging are installed on the supporting body 2 in the fixing frame 3. The rams can be driven to move upwards or downwards by electric means, and can be adjusted on height by numerical control method, forming the upper adjustable mold 4. The pressing machine 6 is used to drive the upper adjustable mold 4 to move downwards, and apply pressure on the board 7, thus to realize the purpose of board formation. Or use a group of (M−1)×(N−1) oil cylinders to drive various upper adjustable molds 4 respectively, forming the upper adjustable mold 4. To apply pressure on the board 7 placed between them can not only realize the 3D curved surface punching formation of the designed curved surface 5 to the board 7, but also achieve the purpose of preventing crumpling and deformation to be generated during board punching. As to the adjustable mold 4, the width shall meet the width requirement of ship plate 7, the length shall cover the length of the ship plate part. By means of feeding and formation in segments, the curved surface formation of relatively long ship plate can be realized.

Figure 3:
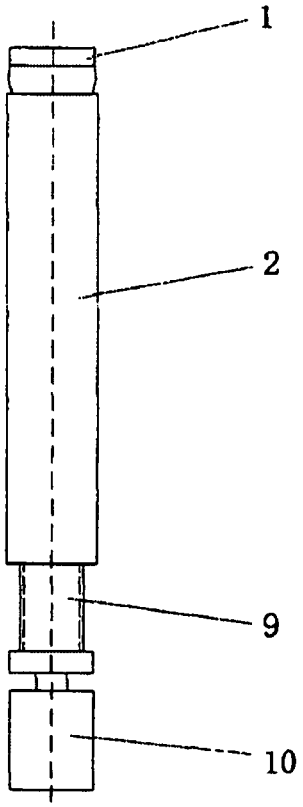
FIG. 3 is the schematic view of the composition of the ram unit in the adjustable molds.

FIG. 3 is the schematic view of the composition of the ram unit in the adjustable molds. The ram unit is composed of the square rams 1, supporting body 2, screw stem 9 and motor 10. The motor 10 can drive the screw stem 9 to rotate and make the ram unit on the adjustable mold 4 move upwards or downwards under the action of the helical pair, thus to regulate the height of the square rams 1 on the end. When a group of M×N square rams 1 on the adjustable molds 4 are regulated well according to the requirement of the designed curved surface 5, they can be use as the curved surface mold required by board formation.

Figure 4:
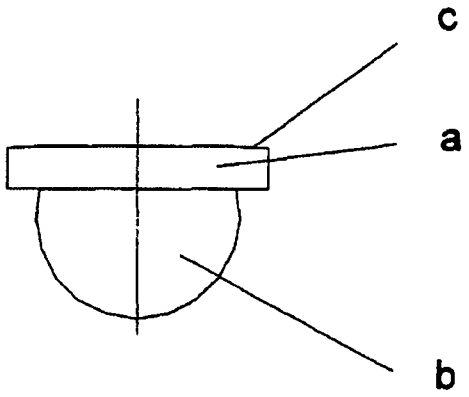
FIG. 4 is the schematic view of the structural style of the square rams.

FIG. 4 is the schematic view of the structural style of the square rams. The square rams 1 are composed of two parts: the square plate a and the sphere b. The pressure imposition surface of the square plate a is a plane or spherical surface with a large radius. When the pressure imposition surface is a plane, the edge part of the pressure imposition surface can be provided with a taper or arc c so that the pressure imposition surface of the square rams 1 is not with a sharp angle and the dents on the plate can be avoided. Compared with other multi-ram board bending method or rams for the multi-point board forming device, the contact area between the square rams 1 and the board 7 is maximized, thus there are advantages of unstable pressure prevention on the board 7 and the reduction of dents.

In this embodiment, the adjustable molds 4 comprise a fixing frame 3 and the ram unit. M×N ram unit is arranged in the fixing frame 3. The ram unit is set to include square rams 1, supporting body 2, spring 8, screw stem 9 and motor 10. The square rams 1 are set to be composed of a square plate a and a sphere b. The upper end surface of the supporting body 2 is provided with a cavity. The square plate a of the square rams 1 is designed to be a plane. The sphere b of the square rams 1 is set to contact the upper end surface of the supporting body 2. The square rams 1 are set to connect the supporting body 2 via the spring 8. The lower end of the supporting body 2 is connected with the screw stem 9 which is designed to link the motor 10. The outer nut coupled with the screw stem is set to connect the fixing frame 3 in a fixed manner.

Figure 5:
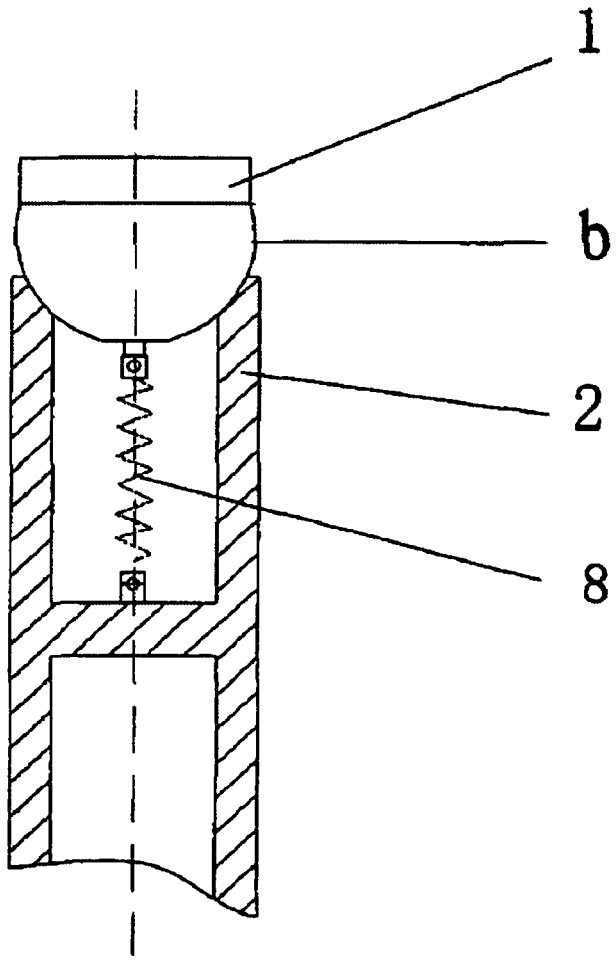
FIG. 5 is the schematic view of the connection between the square rams and the adjustable molds.

FIG. 5 is the schematic view of the connection between the square rams and the adjustable molds. To realize the curved surface formation processing of the board 7, the square rams 1 must be fit for the bending of the board 7 and provided with sufficient swinging amplitude. Therefore, the sphere b part of the square rams 1 is located on the supporting body 2 with concave spherical surface on the end in the fixing frame 3. The spring 8 is used to flexibly and firmly connect the square rams 1 with the fixing frame 3 so that the square rams 1 can get the swinging requirement fit for the board curved surface formation.

Figure 6:
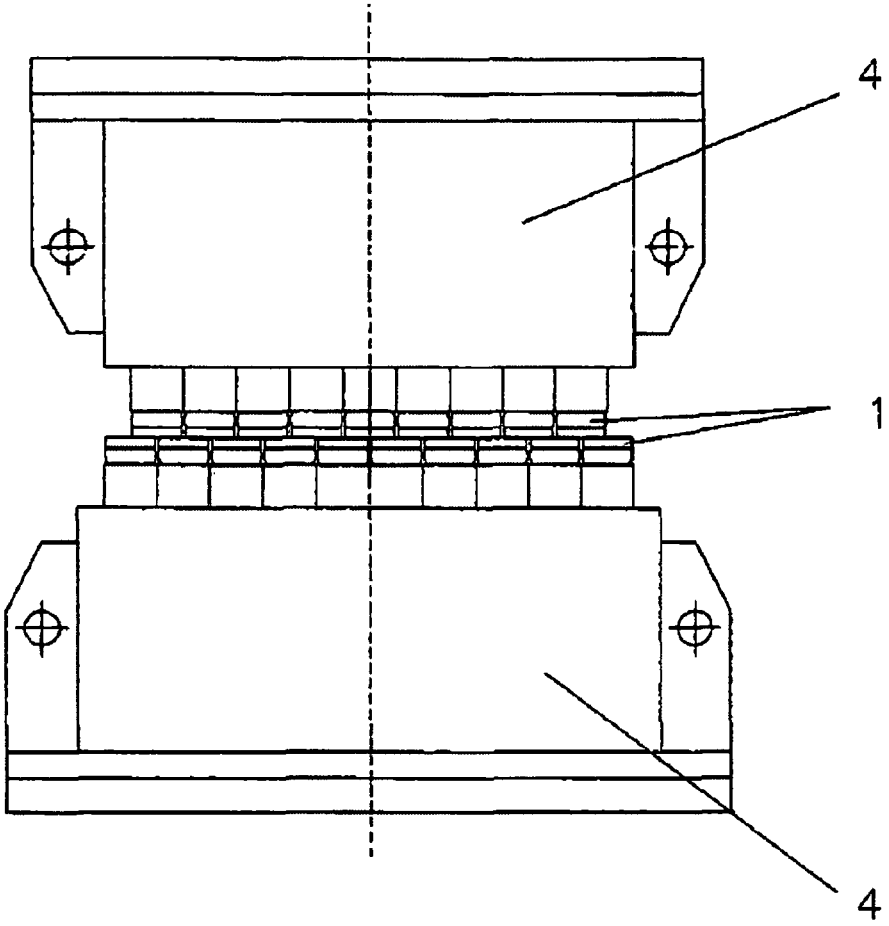
FIG. 6 is the schematic view of the arrangement of the upper and lower adjustable molds.

FIG. 6 is the schematic view of the arrangement of the upper and lower adjustable molds. The upper and lower adjustable molds are arranged in the following mode: an adjustable mold 4 is composed of a group of (M−1)×(N−1) square rams 1 closely positioned in a rectangular shape, and an adjustable mold 4 is compose of a group of M×N square rams 1 closely positioned in a rectangular shape, the projection of the center of the upper adjustable mold 4 and that of the lower adjustable mold 4 is coincident on a transverse plane, so the square rams 1 in the upper adjustable mold 4 and the lower adjustable mold 4 are symmetrically arranged in an interlaced manner in both transverse and longitudinal directions. When applying a pressure on the board 7, the square rams 1 can be mutually supported without the possibility of inclined swinging of the square rams 1 due to the deformation of the boards. Any square ram 1 on the upper adjustable mold 4 can be supported by the adjacent four square rams 1 on the upper adjustable mold 4. On the contrary, any square ram 1 on the lower adjustable mold 4 can be supported by the adjacent four square rams 1 on the upper adjustable mold 4. The square rams 1 may not have inclined swinging due to the instability of the board and can force the board 7 to conduct plastic formation in the clearance defined by the upper and lower molds, thus effectively preventing the crumpling of the board.

In this embodiment, the sectional area of all the square rams 1 is set to be the same. The upper adjustable mold 4 is set to be composed of (M−1)×(N−1) square rams 1 and the lower adjustable mold 4 is set to be composed of M×N square rams 1. The square rams 1 in the upper and lower adjustable molds 4 are set to be arranged in the same way. The central lines of the longitudinal section of the upper and lower molds 4 are set to be on the same vertical line, thus ensuring the manual supporting of the upper and lower square rams 1.

Figure 7:
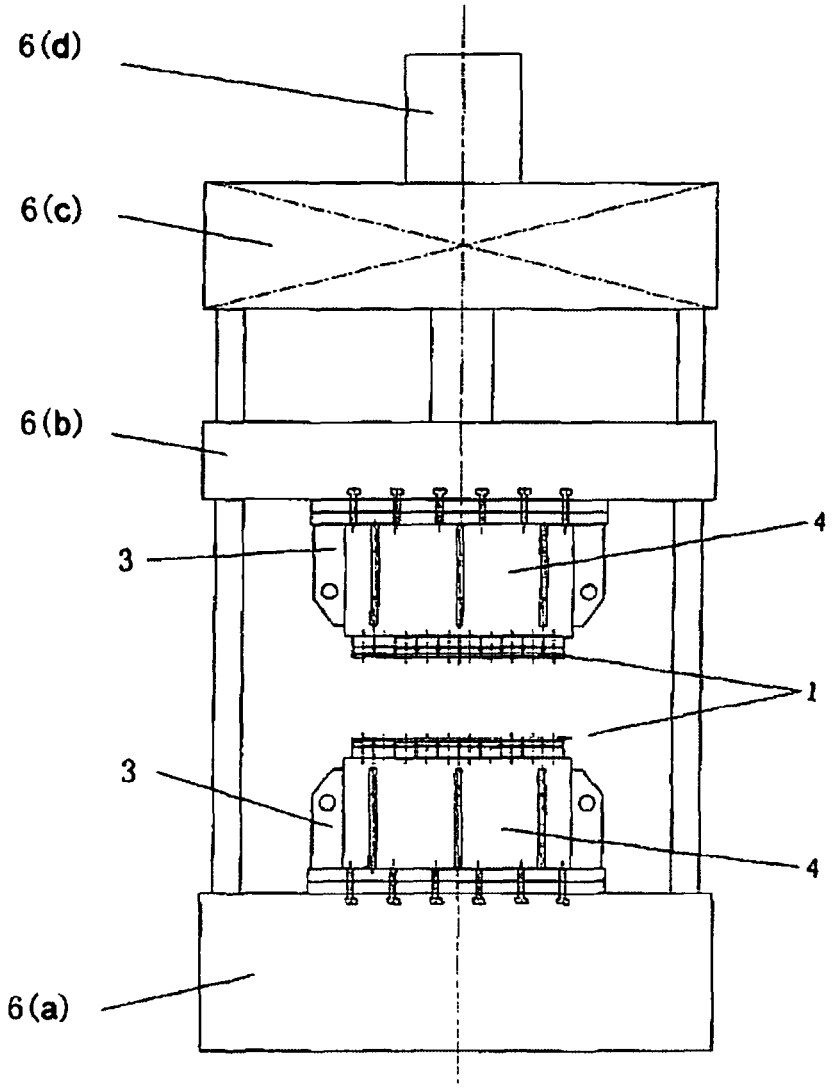
FIG. 7 is the schematic view of the board curved surface forming device by using the adjustable molds of square rams.

FIG. 7 is the schematic view of the curved surface forming device for adjustable segmented mold board with square rams. The curved surface forming device for adjustable segmented mold board with square rams comprises: 1—square rams, 2—supporting body, 3—fixing frame, 4—adjustable mold and 6—pressing machine. The loading mechanism in this embodiment is pressing machine 6. The supporting body 2 with a group of square rams 1 is mounted in the fixing frame 3 to form the upper and the lower adjustable molds 4. The lower adjustable mold 4 is installed on the base 6(*a*) of the pressing machine 6. The upper adjustable mold 4 is installed on the movable cross beam 6(*b*) of the pressing machine 6. The movable cross beam 6(*b*) is connected with the pressure imposition oil cylinder 6(*d*) installed on the upper beam 6(*c*). Driven by the pressure imposition oil cylinder 6(*d*), the upper adjustable mold 4 can move upwards and downwards to punch the board to be processed together with the lower adjustable mold 4.

Based on the description above, the upper and the lower adjustable molds of the present invention is equipped with square rams 1 with the pressure imposition surface to be a plane, when punching the board, the square rams 1 contact the board on a surface basis, thus greatly reducing the clearance between the square rams 1. The square rams 1 of the upper and the lower adjustable molds are arranged in an interlaced manger, which leads to the impossibility of the superposition of the clearances between the square rams 1 of the upper and the lower adjustable molds, thus effectively preventing the crumpling, deformation and dents and improving processing quality.

What is claimed is:

1. A curved surface forming device for an adjustable segmented mold board with square rams, comprising an upper group and a lower group of square rams, height adjustable molds and a loading mechanism, wherein the upper group and the lower group of adjustable molds are arranged in the loading mechanism and at least one group of the adjustable molds can move up and down under a drive of the loading mechanism; wherein the adjustable molds are provided with a group of square rams in the quantity of M×N arranged densely and installed on the supporting body in a fixing frame, forming the lower or the upper adjustable molds; and a group of square rams in the quantity of (M−1)×(N−1) arranged densely and installed on the supporting body in the fixing frame, thus forming the upper or the lower adjustable molds; the height of each square ram in the upper and the lower adjustable molds can be adjustable, and the square rams of the upper and the lower adjustable molds are arranged in an interlaced manner in both transverse and longitudinal directions; the square rams are composed of two parts: a square plate and a sphere; one side of the square plate is a pressure imposition surface and the other side is the sphere; the pressure imposition surface of the square plate is a plane, an edge part of the pressure imposition surface can be provided with a taper or arc; the sphere is located on the inner end concave spherical surface of the supporting body, and is flexibly coupled with the square rams via a spring.

2. The curved surface forming device for an adjustable segmented mold board with square rams as claimed in claim 1, wherein the sectional area of all the square rams is set to be the same, the upper adjustable mold is set to be composed of (M−1)×(N−1) square rams and the lower adjustable mold is set to be composed of M×N square rams, the square rams in the upper and lower adjustable molds are set to be arranged in the same way, central lines of the longitudinal section of the upper and lower molds are set to be on the same vertical line.

3. The curved surface forming device for an adjustable segmented mold board with square rams a claimed in claim 1, wherein the adjustable mold comprises a fixed frame and the ram unit, wherein M×N am unit is arranged in the fixing frame, the ram unit is set to include square rams, supporting body, spring, screw stem and motor; the upper end surface of the supporting body is provided with a cavity; the square plate of the square rams is designed to be a plane; the sphere of the square rams is set to contact the upper end surface of the supporting body; the square rams are set to connect the supporting body via the spring; the lower end of the supporting body is connected with the screw stem which is designed to link the motor; an outer nut coupled with the screw is set to connect the fixing frame in a fixed manner.

4. The curved surface forming device for an adjustable segmented mold board with square rams as claimed in claim 3, wherein on the section of the adjustable molds, the transverse direction of the section of the square rams is set to be parallel to the transverse direction of the section of the fixing frame; the longitudinal direction of the section of the square rams is set to be parallel to the longitudinal direction of the section of the fixing frame.

* * * * *